US006287130B1

(12) United States Patent
Torii

(10) Patent No.: US 6,287,130 B1
(45) Date of Patent: Sep. 11, 2001

(54) CONSTRUCTION AND METHOD OF CONNECTING CONNECTOR TO BASE BOARD

(75) Inventor: Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/516,151

(22) Filed: Mar. 1, 2000

(30) Foreign Application Priority Data

Mar. 1, 1999 (JP) ..... 11-052428

(51) Int. Cl.[7] ..... H01R 9/09
(52) U.S. Cl. ..... 439/83
(58) Field of Search ..... 439/78, 83, 84, 439/733.1, 876, 607

(56) References Cited

U.S. PATENT DOCUMENTS 5,197,891 * 3/1993 Tanigawa et al. ..... 439/83
5,200,884 * 4/1993 Ohashi ..... 361/401
5,490,788 * 2/1996 Mazzochette ..... 439/83
5,686,726 * 11/1997 Lwee et al. ..... 439/83
5,938,456 * 8/1999 Kozel et al. ..... 439/83

FOREIGN PATENT DOCUMENTS

3710394-A1 * 10/1988 (DE) .
3-79170 * 8/1991 (JP) .

* cited by examiner

*Primary Examiner*—Brian Sircus
*Assistant Examiner*—Than-Tam Le
(74) *Attorney, Agent, or Firm*—Sughrue, Mion, Zinn, Macpeak & Seas, PLLC

(57) ABSTRACT

A connector insertion hole (26) is formed through a circuit board (12), and a connector (1) is inserted into the connector insertion hole (26) from one side of the circuit board (12) to be projected from the other side of the circuit board (12). A plurality of board-connecting terminals (5) are connected respectively to solder portions at the one side of the circuit board (12). Each of the board-connecting terminals (5) has a solder-connecting surface (11*a*) facing in the connecting-inserting direction. Fixing metal members (10) are provided on the connector (1), and each of the fixing metal members (10) has a solder-fixing surface facing in the connector-inserting direction. The fixing metal members (10) are fixedly secured to the one side of the circuit board (12) by soldering simultaneously when the board-connecting terminals (5) are connected to the circuit board (12).

6 Claims, 7 Drawing Sheets

CONSTRUCTION AND METHOD OF CONNECTING CONNECTOR TO BASE BOARD

BACKGROUND OF THE INVENTION

1. Field of the Invention

The present invention relates to a construction of and a method of connecting a connector to a base board, in which the connector can be provided on either side of the circuit board even in the case where solder portions are formed only on one side of the circuit board.

The present application is based on Japanese Patent Application No. Hei. 11-52428, which is incorporated herein by reference.

2. Description of the Related Art

FIG. 6 shows a related construction of connecting a connector to a base board.

In this construction, a plurality of external board-connecting terminals 51 of the board-connecting connector (hereinafter referred to as "connector") 40 are connected respectively to terminal-connecting portions of a printed circuit (not shown) on a front side or surface of an electronic circuit board (hereinafter referred to as "circuit board") 50 by reflow soldering. The connector 40 is mounted on the surface of the circuit board 50 by soldering.

Rows of solder portions 52 are formed on the front side (upper surface) of the circuit board 50, and the rows of board-connecting terminals 51 project outwardly respectively from lower portions of opposite side walls 54 of a connector housing 53 made of a synthetic resin. Each board-connecting terminal 51 is downwardly bent into a crank-shape, and a lower surface of a distal end portion 55 thereof is connected to the upper surface of the circuit board 50 through the solder portion 52.

A flange 56 is formed integrally with a bottom portion of the connector housing 53, and proximal end portions of the board-connecting terminals 51 are disposed on an upper surface of the flange 56. Fixing metal members 60 of an L-shape are provided respectively at opposite end walls 59 of the connector housing 53, and each fixing metal member 60 is engaged in grooves 61, and a lower portion of each fixing metal member 60 is received in a notch 62 in the flange 56, and is fixed at its lower surface to a solder portion 52 on the front side of the circuit board 50. The soldering connection of the board-connecting terminals 51 to the circuit board 50 and the solder-fixing of the fixing metal members 60 are effected simultaneously by a reflow soldering apparatus (described later).

FIGS. 7A to 7D show a related reflow soldering method.

First, as shown in FIGS. 7A and 7B, a sheet 64 of a synthetic resin, having a plurality of holes 63, is placed on the circuit board 50, and a cream solder 65 is put on the sheet 64, and is spread over this sheet, using a knife (not shown). The holes 63 in the sheet 64 are so arranged as to correspond to the relevant solder portions, respectively. The cream solder fills in the holes 63, and deposits on the circuit board 50. Then, the sheet 64 is removed as shown in FIG. 7C, and solder portions 52 are formed on predetermined portions of the circuit board 50, respectively.

Then, the connector 40 is fixedly secured to the solder portions 52 by a thermosetting adhesive (not shown) as shown in FIG. 7D. In this condition, the circuit board 67 with the connector is heated by a reflow soldering apparatus (not shown), and therefore the solder portions 52 are melted, so that the board-connecting terminals 52 (see FIG. 6) of the connector 40 are connected to the circuit board 50 by soldering.

In FIG. 6, when it is desired to provide the connectors 40 on the opposite (front and reverse) sides (surfaces) of the circuit board 50, respectively, solder portions 52 are formed on each side of the circuit board 50 by the above method. By doing so, the two connectors 40 can be connected respectively to mating connectors (not shown) at the opposite sides of the circuit board 50. In the case where such solder portions 52 can not be formed on one side (reverse side) of the circuit board 50, for example, because of the form of the printed circuit on the circuit board 50 and the kind of the reflow soldering apparatus, a connector 41 of the through hole-connecting type is provided on the reverse surface of the circuit board 50 as shown in FIG. 8, board-connecting terminals 68 of the connector 41 are passed respectively through through holes 69 in the circuit board 50, and are connected respectively to solder portions 70 (other than the reflow solder portions) on the front side of the circuit board 50.

In the above construction and method of connecting the connector to the base board, however, in the case where the solder portions 52 can be formed only on one side of the circuit board 50, there are required two steps, that is, the step of connecting the connector 40 to the front side of the circuit board 50 by the reflow soldering apparatus, and the step of subsequently connecting the reverse-side connector 41 to the through holes 69 in the circuit board 50 by soldering. Therefore, the productivity is low, and much time and labor are required for the assembling operation, and particularly when manually soldering the board-connecting terminals 68 to the respective through holes 69, there has been encountered a problem that the efficiency of the operation is extremely low. In the case where the solder portions are formed on the opposite sides (surfaces) of the circuit board 50, there have been encountered problems that the time and labor, twice larger than those required with the method of FIG. 7, are needed and that the operation is cumbersome. In the case where the connectors 40 are connected respectively to the opposite sides of the circuit board 50 by soldering, using the reflow soldering apparatus, the solder portions 52 on the lower side of the circuit board 50 drip, and therefore the soldering connection is difficult, which has resulted in a problem that complicated techniques and the high cost are required. A further problem is that the structure becomes bulky in the direction of the thickness of the circuit board 50 since the connector housing 53 projects from the surface of the circuit board 50 through the flange 56.

With the above problems in view, it is an object of the present invention to provide a construction and a method of connecting a connector to a base board, in which a board-connecting connector can be efficiently provided on either side of the circuit board with less time and labor even in the case where solder portions can be formed only on one side of the circuit board, and the increase of the time and labor due to the formation of solder portions on opposite sides of the circuit board are eliminated, and connectors can be positively and easily connected to the opposite sides of the circuit board, respectively, and the structure is prevented from becoming bulky.

To achieve the above object, according to one aspect of the present invention, there is provided a construction of connecting a connector to a circuit board, which comprises a circuit board having a connector insertion hole formed therethrough, a plurality of solder portions formed on one of opposite sides of the circuit board, and a plurality of board-connecting terminals attached to a connector, the board-connecting terminals being respectively connected to the solder portions, wherein the connector is inserted into the connector insertion hole from the one side of the circuit board, and each of the board-connecting terminals has a solder-connecting surface facing in a direction of insertion of the connector. According to the present invention, it is preferable that the above construction further comprises a plurality of fixing metal members provided on the connector, and each of the fixing metal members having a solder-fixing surface facing in the direction of insertion of the connector.

Further, according to another aspect of the present invention, there is provided a method of connecting a connector to a circuit board. The method comprises the steps of forming a plurality of solder portions on a circuit board, forming a connector insertion hole through the circuit board, inserting a connector having a plurality of board-connecting terminals into the connector insertion hole from one side of the circuit board, so that the connector projects from the other side of the circuit board, and subsequently connecting the board-connecting terminals of the connector respectively to the solder portions at the one side of the circuit board. According to the present invention, it is preferable that the connector has a plurality of fixing metal members, and the above method further comprises a step of securing the fixing metal members fixedly to the one side of the circuit board by soldering simultaneously when the board-connecting terminals are connected to the solder portions, respectively.

DETAILED DESCRIPTION OF THE PREFERRED EMBODIMENT

A preferred embodiment of the present invention will now be described in detail with reference to FIGS. 1 to 5.

Figure 1:
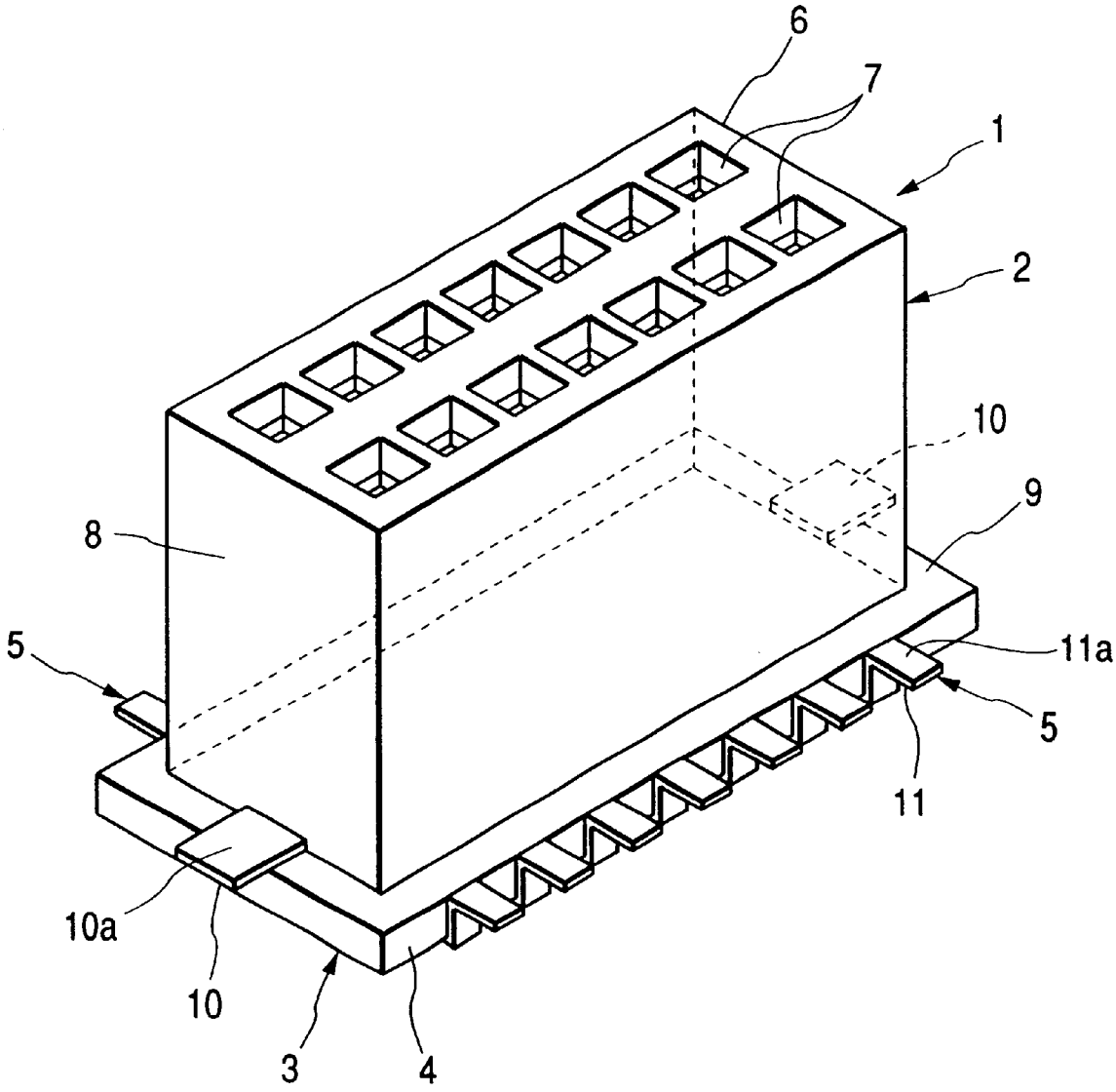
FIG. 1 is a perspective view showing one example of a board-connecting connector used in a construction of and a method of connecting a connector to a base board, provided in accordance with the present invention.

FIG. 1 shows one example of a board-connecting connector used in a construction of and a method of connecting a connector to a base board, provided in accordance with the present invention.

This board-connecting connector (hereinafter referred to as "connector") 1 includes a rectangular connector housing 2, made of a synthetic resin, a flange 3 formed integrally with a bottom of the connector housing 2, and a plurality of board-connecting terminals 5 projecting outwardly at an upper side of the flange 3.

Two rows of mating terminal insertion holes 7 are formed in a fitting surface (upper surface) 6 of the connector housing 2. Fixing metal members 10 are provided respectively at lower ends of opposite end walls 8 of the connector housing 2, and extend horizontally in contiguous relation to the upper surface 9 of the flange 3. The fixing metal members 10 are fixedly secured to the connector housing 2, for example, by insert molding.

Figure 3:
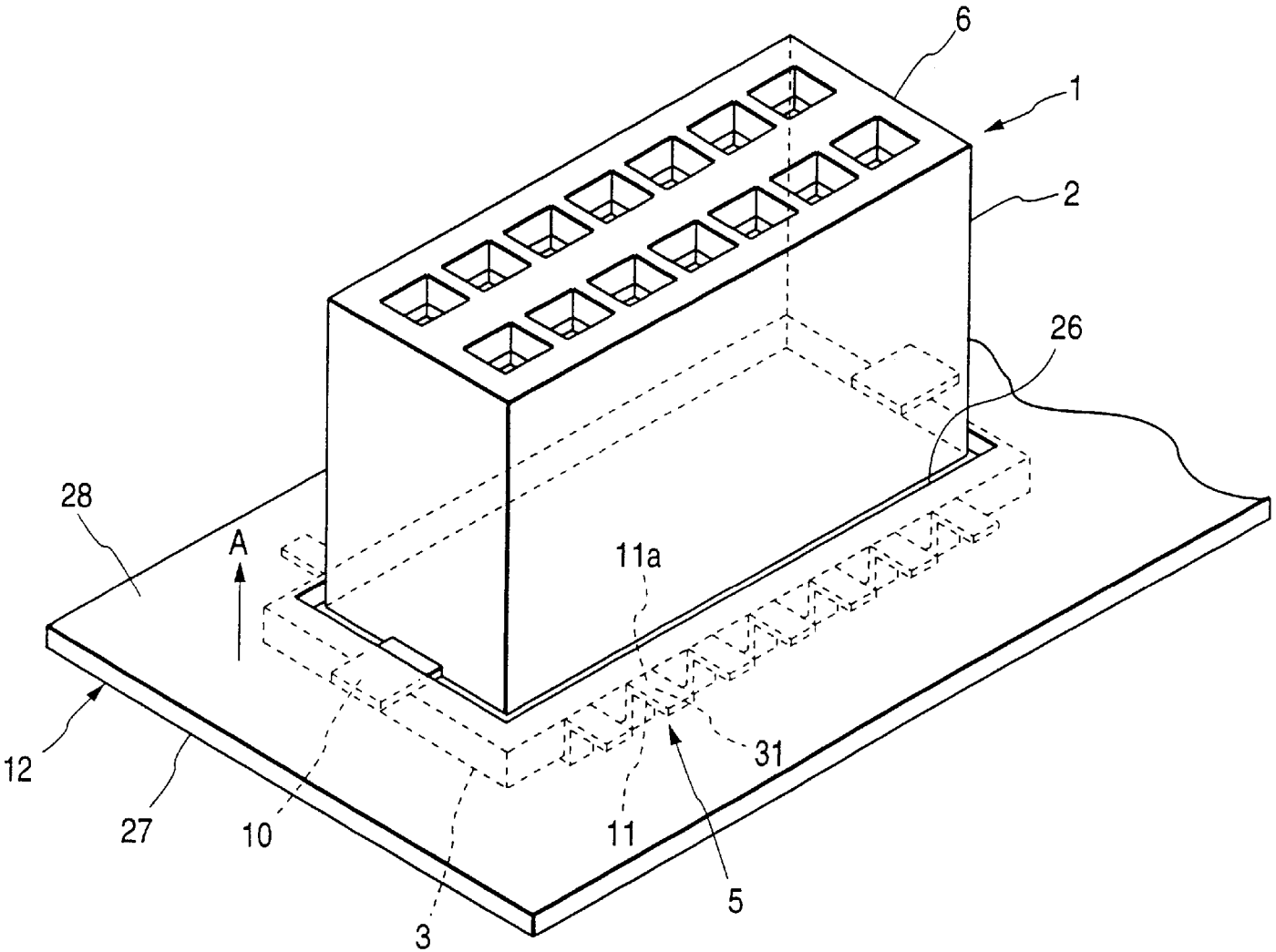
FIG. 3 is a perspective view showing the board-connecting connector connected to a circuit board by soldering.

Two rows of board-connecting terminals 5 are provided at opposite side surfaces (longer side surfaces) 4 of the flange 3, respectively. An upper surface 11*a* of a connecting portion 11 of each board-connecting terminal 5 is disposed substantially flush with the upper surface 9 of the flange 3, and serves as a solder-connecting surface for a circuit board 12 (FIG. 3). Upper surfaces 10*a* of the fixing metal members 10 serve as solder-fixing surfaces for the circuit board 12.

Figure 2B:
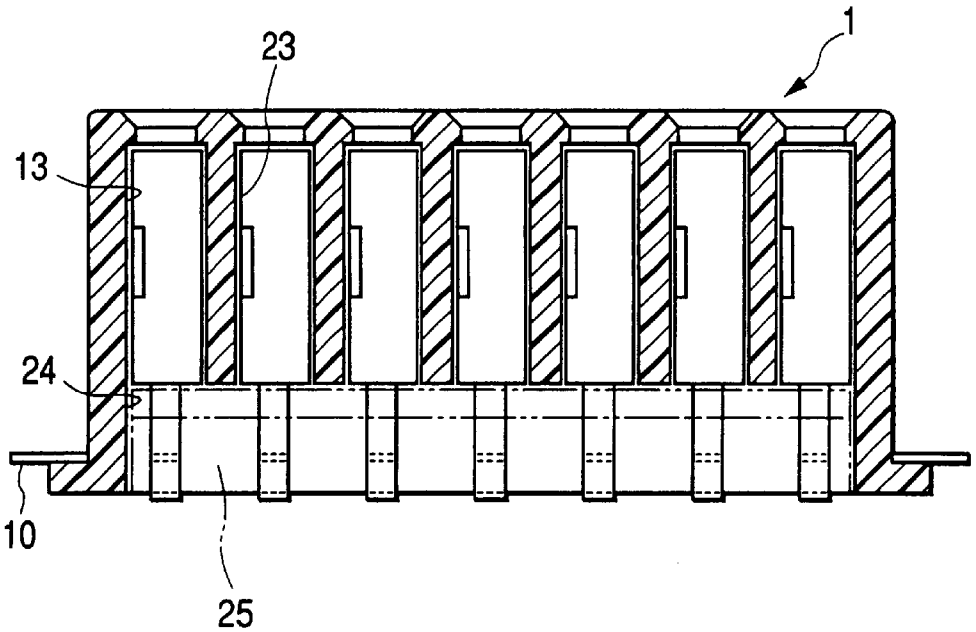
FIG. 2B is a longitudinal cross-sectional view of the connector.
Figure 2A:
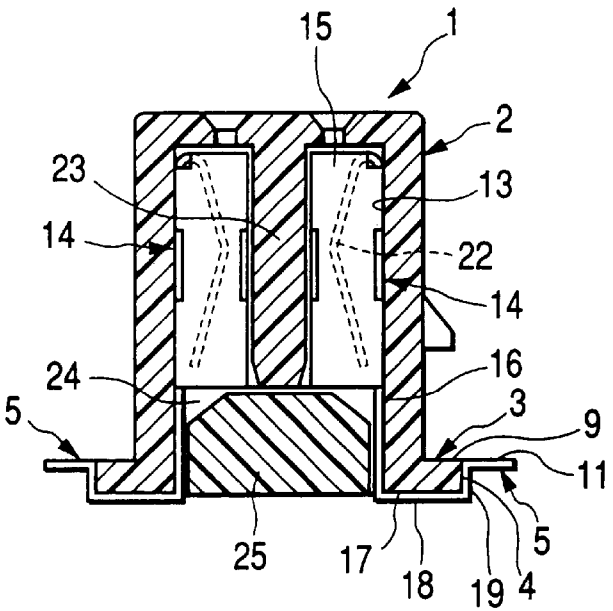
FIG. 2A is a transverse cross-sectional view of the board-connecting connector.

FIGS. 2A and 2B show the transverse and longitudinal cross-sections of the connector 1, respectively. As shown in FIG. 2A, two rows of terminal receiving chambers 13 are formed within the connector housing 2, and female terminals 14 are received in the terminal receiving chambers 13, respectively. The female terminals 14, received respectively in one row of the terminal receiving chambers 13, are disposed in symmetrical, opposed relation respectively to the female terminals 14 received respectively in the other row of terminal receiving chambers 13. Each of the female terminals 14 has a box-like electrical contact portion 15, and a base plate portion 16 extends from the electrical contact portion 15, and is bent perpendicularly at the bottom of the connector housing 2, and further extends horizontally in contiguous relation to a lower surface 17 of the flange 3 (or a surface of a groove), and this extension portion 18 is bent to rise vertically in contiguous relation to the side surface 4 of the flange 3, and this rise portion 19 is bent to extend horizontally outwardly substantially flush with the upper surface 9 of the flange 3, thereby providing the connecting portion 11 for the circuit board 12 (FIG. 3). The board-connecting terminal 5 is defined by the rise portion 19 and the connecting portion 11 which are disposed outwardly of the flange 3. The two rows of the board-connecting terminals 5, provided respectively at the opposite sides of the flange 3, are arranged symmetrically.

A resilient contact piece portion 22 for contact with a male terminal 21 in a mating connector 20 (FIG. 4) is provided within the boxlike electrical contact portion 15 of the female terminal 14. As shown in FIG. 2B, the terminal receiving chambers 13 are separated from one another by partition walls 23, and a terminal retaining spacer 25 is received in a space (chamber) 24 provided below the terminal receiving chambers 13.

FIG. 3 shows a condition in which the connector 1 is connected to the circuit board 12 by soldering.

A connector insertion hole 26, which is slightly larger in size than the fitting surface (upper surface) 6 of the connector housing 2, is formed through the circuit board 12. The connector housing 2 is inserted into the connector insertion hole 26 from a reverse side (surface) 27 of the circuit board 12, and extends through the circuit board 12 to project from a front side (upper surface) 28 of the circuit board 12. In this condition, the upper surfaces (solder-connecting surfaces) 11*a* of the connecting portions 11 of the board-connecting terminals 5 are connected respectively to solder portions 31 formed on the reverse side 27 of the circuit board 12.

The solder-connecting surfaces 11a face in the connector-inserting direction. Arrow A denotes the connector-inserting direction. The plurality of solder portions 31, corresponding respectively to the plurality of board-connecting terminals 5, are formed on the circuit board 12 at a peripheral edge portion of the connector insertion hole 26. Solder portions, corresponding respectively to the fixing metal members 10, are formed on the reverse side 27 of the circuit board 12, and the fixing metal terminals 10 are fixed (soldered) to the reverse side 27 of the circuit board 12 simultaneously when the board-connecting terminals 5 are connected (soldered) respectively to the solder portions 31.

In this embodiment, the solder portions 31 are formed only on the reverse side 27 of the circuit board 12 by a related reflow soldering method (see FIG. 7). The solder portions 31, corresponding respectively to the board-connecting terminals 5, are provided at terminal portions of a printed circuit (not shown) and intermediate lands. The flange 3 is held against the reverse side 27 of the circuit board 12. Incidentally, one side 27 of the circuit board 12 is the reverse side when the connector housing 2 projects upwardly, and when the circuit board 12 is used in an inverted manner, this side 27 is the front side.

Figure 6:
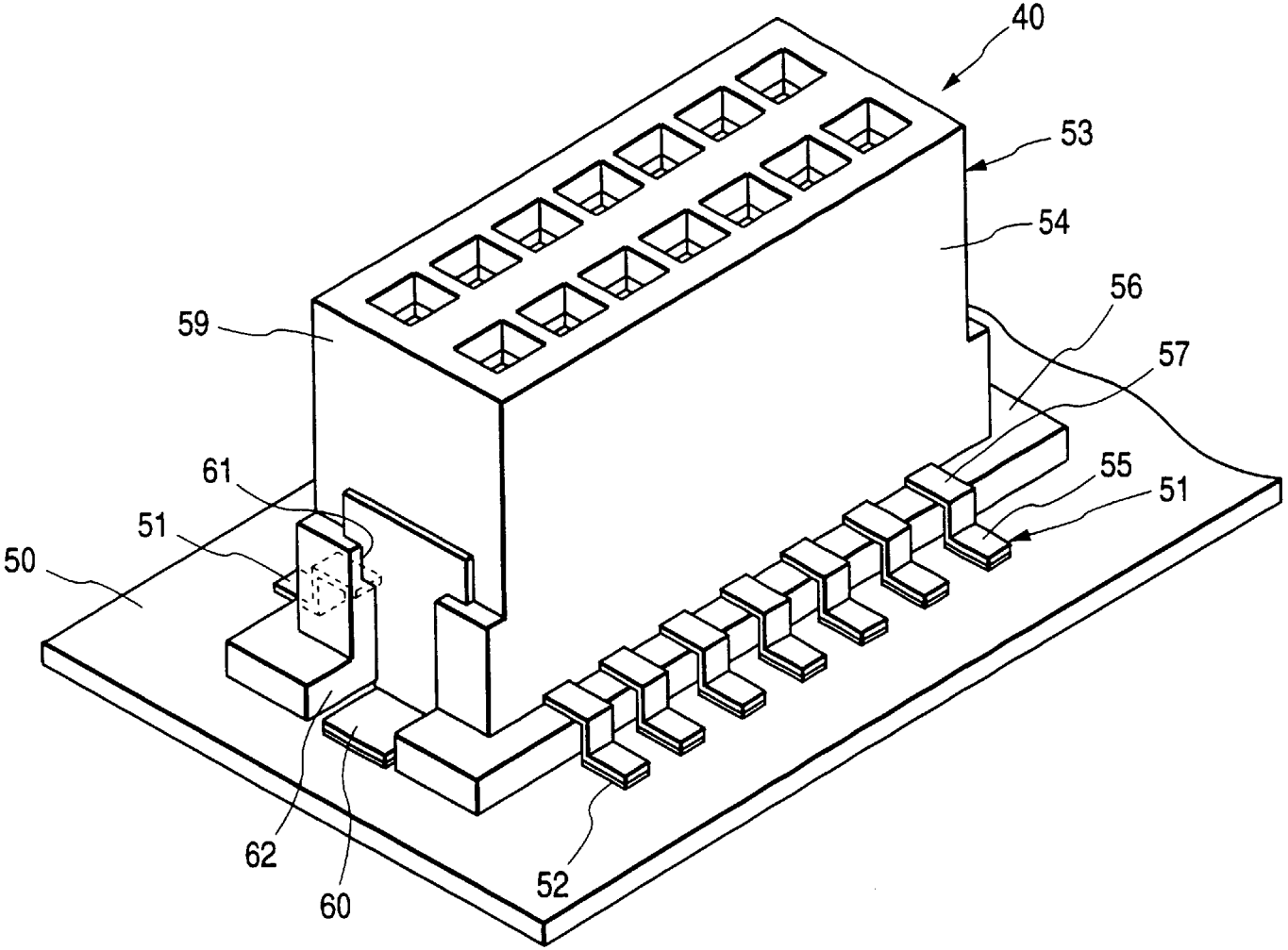
FIG. 6 PRIOR ART
FIG. 6 is a perspective view showing a related construction of connecting a connector to a base board.
Figure 7A:
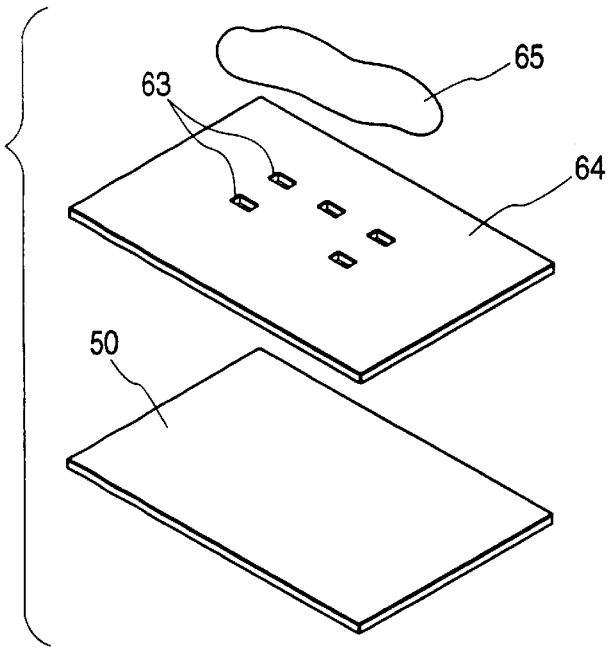
FIG. 7A PRIOR ART
FIGS. 7A to 7D are views explanatory of a related reflow soldering process.
Figure 7C:
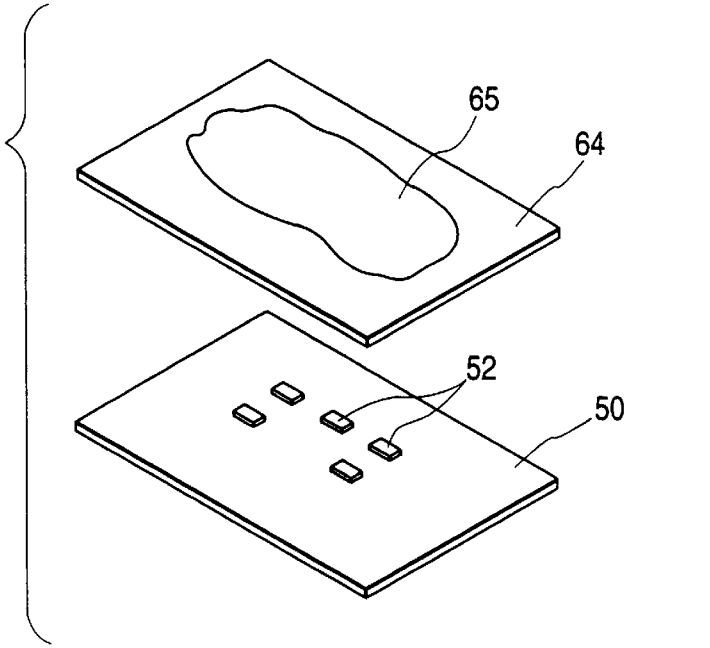
FIG. 7C PRIOR ART
Figure 7B:
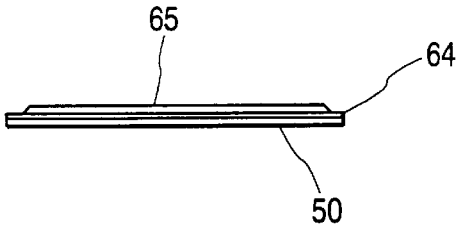
FIG. 7B PRIOR ART
Figure 7D:
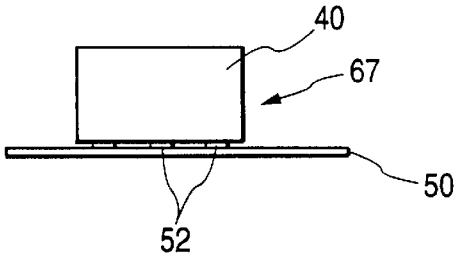
FIG. 7D PRIOR ART

For example, the connector 40, shown in FIG. 6 (the related construction), can be connected to the reverse side 27 of the circuit board 12 by soldering, in which case the connector 40 is projected at the reverse side 27 of the circuit board 12. Even in the case where the solder portions 31 can be formed only on one side (reverse side) 27 of the circuit board 12, the connector can be provided on either side (the front or the reverse side) of the circuit board 12 in a projected manner, and also the connectors 1 and 40 can be provided respectively on the opposite sides of the circuit board 12 in a projected manner.

And besides, there is no need to use the connector 41 of the through hole-connecting type as in the related construction. A plurality of through holes for soldering purposes do not need to be formed through the circuit board 12, and therefore the printed circuit (not shown) can be formed over a larger area. Furthermore, the connector housing 2 extends through the circuit board 12, and projects from the upper side 28 of the circuit board 12 whereas the flange 3 is disposed on the reverse side 27 of the circuit board 12, and therefore the length of projecting of the connector 1 from the circuit board 12 is reduced, and besides the thickness of the circuit board 12 is absorbed by the height of projecting of the connector 1, so that the structure is compact in size.

These effects are achieved by the above construction of connecting the connector to the board, and also can be achieved by a method of connecting the connector to the board, in which the insertion hole 26, slightly larger than the fitting surface (upper surface) 6 of the connector housing 2, is formed through the circuit board 12, and reflow solder portions are formed on one side (reverse side) 27 of the circuit board 12, and the connector housing 2 is inserted into the connector insertion hole 26 from the one side of the circuit board 12, and projects from the other side (front side) 28 of the circuit board 12, and the connecting portions of the board-connecting terminals 5 are connected respectively to the solder portions 31 on the one side (reverse side) 27 of the circuit board 12. There can be used an arrangement in which the solder portions 31 are formed on the front side 28 of the circuit board 12, and a related connector (for example, the connector 40 of FIG. 6) is provided on the front side 28 of the circuit board 12.

Figure 4:
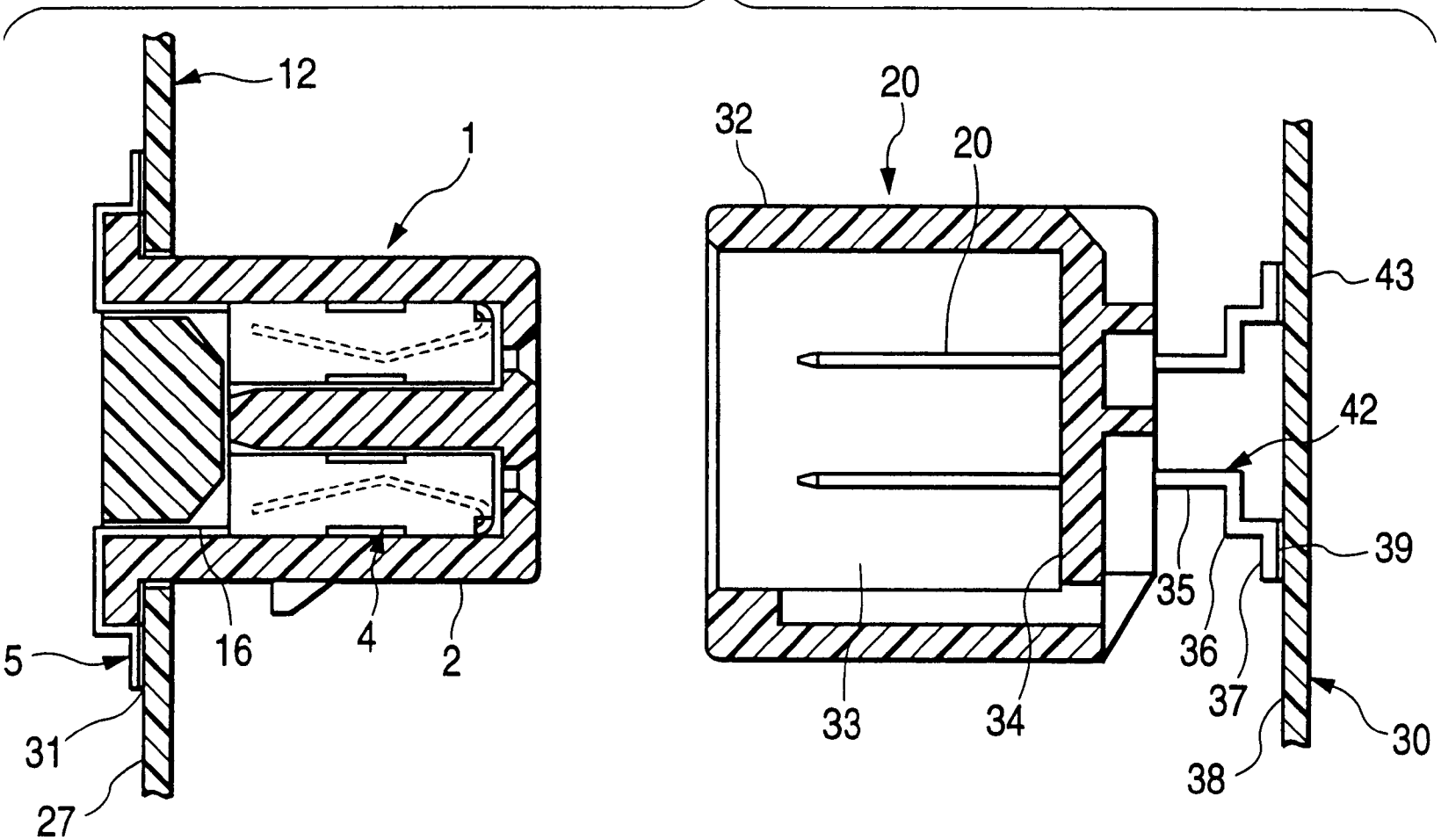
FIG. 4 is a vertical cross-sectional view showing the manner of connecting two connectors, mounted respectively on two circuit boards, together.
Figure 5:
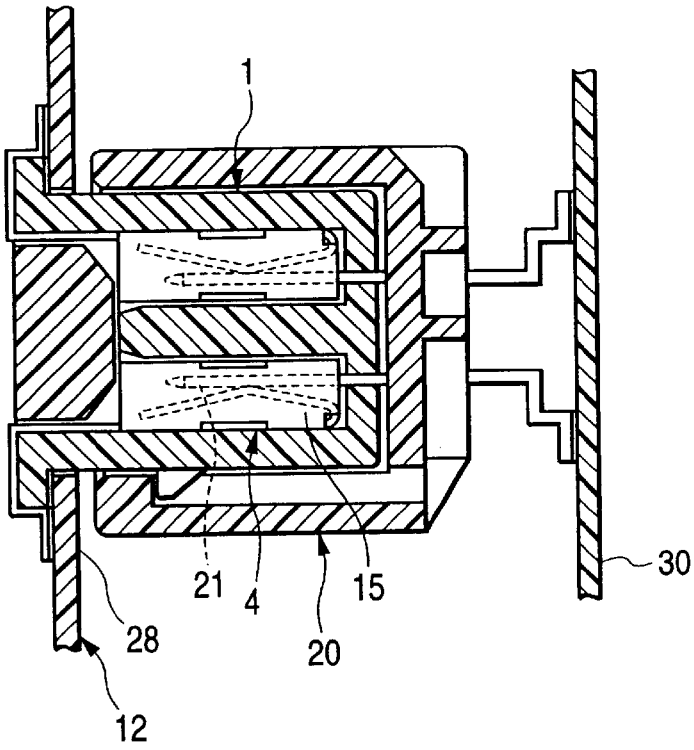
FIG. 5 is a vertical cross-sectional view showing a condition in which the two connectors are fitted and connected together.
Figure 8:
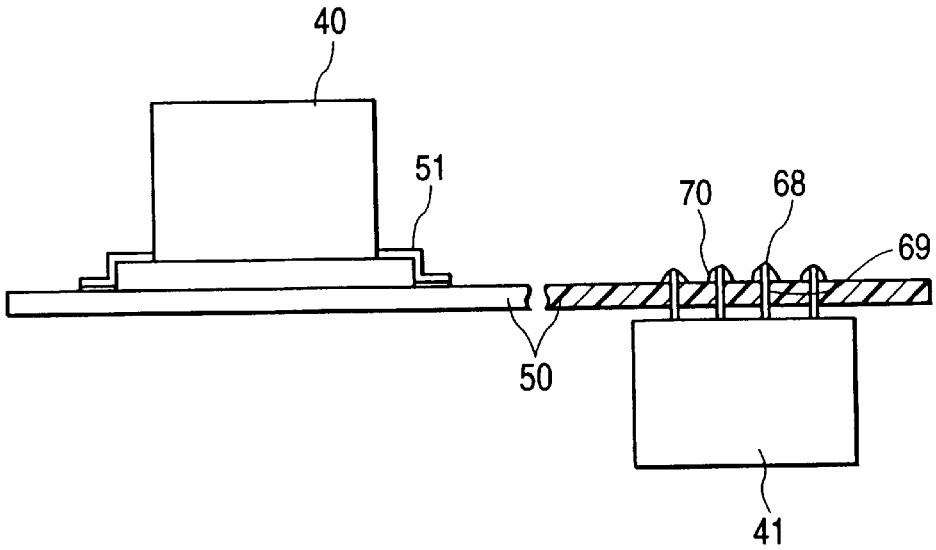
FIG. 8 PRIOR ART
FIG. 8 is a view showing a condition in which two connectors are mounted on opposite sides of the related circuit board, respectively.

FIGS. 4 and 5 show the manner of connecting the board-connecting male and female connectors 1 and 20 (connected respectively to two circuit boards 12 and 30 by soldering) together.

More specifically, the male connector 1 is connected to the circuit board 12 by soldering, and the female connector 20 is connected (soldered) to the circuit board 30 by a method as described above for the related construction, and the two circuit boards 12 and 30 are moved toward each other, thereby fitting (or connecting) the two connectors 1 and 20 together.

As shown in FIG. 4, the male connector 1 has the female terminals 14 received in the connector housing 2 as shown in FIG. 2, and each female terminal 14 is formed into the board-connecting terminal 5 via the base plate portion 16, and the board-connecting terminals 5 are connected to the reverse side 27 of the circuit board 12 by the respective solder portions 31.

The female connector 20 has the male terminals 21 provided in a fitting chamber 33 in a connector housing 32, and the male terminals 21 extend through a bottom wall 34 of the fitting chamber 33 toward the circuit board 30. These extension portions 35 are bent outwardly into a crank-shape, and distal end portions of these bent portions 36 are formed into connecting portions 37, respectively, and these connecting portions 37 are connected respectively to solder portions 39 on a reverse side 38 of the circuit board 30. A board-connecting terminal 42 is defined by the connecting portion 37 and the bent portion 36. The two connectors 1 and 20 are disposed between the two circuit boards 12 and 30 in opposed relation to each other.

The two circuit boards 12 and 30 are moved toward each other, so that the two connectors 1 and 20 are fitted together as shown in FIG. 5. The male terminals 21 are inserted into and connected to the electrical contact portions 15 of the female terminals 14, respectively. The male terminal 21 is continuous with the board-connecting terminal 42, and the female terminal 14 is continuous with the board-connecting terminal 5, and therefore when the two connectors are connected together, the printed circuits (not shown), formed respectively on the two circuit boards 12 and 30, are connected together. For example, the circuit boards 12 and 30 are provided in equipments of an automobile, electric connection boxes and others, and the equipments or the electric connection boxes are connected together via the two connectors 1 and 20.

In the case where reflow solder portions can not be formed on the front side 28 of the circuit board 12, the above connector solder-connecting construction (and method) is quite effective.

The board-connecting terminal 5 of the male connector 1 can be formed integrally with each male terminal 21 of the female connector 20 so that the female connector 20 can be connected by soldering to a surface 43 (FIG. 4) of the circuit board 30 as described above for the male connector 1. In this case, a connector insertion hole (not shown) is formed through the circuit board 30. The above connector solder-connecting construction (and method) is not limited to the reflow soldering, but can be applied to any other suitable solder portion-forming means.

In the present invention, even in the case where the solder portions can be formed only on one side of the circuit board, the connector is inserted into the connector insertion hole to be projected from the other side of the circuit board, and by doing so, the connector can be connected to the mating connector at the other side of the circuit board on which any solder-connecting portion is not provided. Therefore, various connector-connecting forms can be provided. And besides, the connectors can be easily, efficiently and positively connected respectively to the opposite sides (front and reverse sides) of the circuit board by a single reflow soldering operation (process). Therefore, a cumbersome solder-connecting process as required with a related connector of the through hole-connecting type is not needed, and the time and labor, required for the solder-connecting operation, are reduced, so that the efficiency of the operation is enhanced. Since the connector is received in the connector insertion hole, the dimension of the structure in the direction of the height is reduced by an amount corresponding to the thickness of the circuit board, so that the structure is prevented from become bulky.

In the present invention, the connector is fixedly secured to the circuit board by solder simultaneously when the board-connecting terminals of the connector are connected to the circuit board by soldering, and therefore the strength of fixing of the connector to the circuit board increases.

What is claimed is:

1. A construction for connecting a connector to a circuit board, comprising:

a circuit board having a connector insertion hole formed therethrough;

a plurality of solder portions formed on one of opposite sides of the circuit board; and a plurality of board-connecting terminals attached to a connector, the board-connecting terminals being respectively connected to the solder portions;

wherein the connector is inserted into the connector insertion hole from one side of the circuit board, and each of the board-connecting terminals has a solder-connecting surface facing in a direction of insertion of the connector, and wherein the connector includes a flange continuously formed around a periphery of the connector, said flange having one side that faces the one side of the circuit board, and each of said solder-connecting surfaces of said board-connecting terminals is flush with the one side of said flange.

2. The construction of claim 1, further comprising a plurality of fixing metal members provided on the connector, and each of the fixing metal members having a solder-fixing surface facing in the direction of insertion of the connector.

3. A method of connecting a connector to a circuit board, comprising the steps of:

forming a plurality of solder portions on a circuit board;

forming a connector insertion hole through the circuit board;

inserting a connector having a plurality of board-connecting terminals into the connector insertion hole from one side of the circuit board, so that the connector projects from the other side of the circuit board, wherein the connector includes a flange continuously formed around a periphery of the connector, the flange having one side that faces the one side of the circuit board, and solder-connecting surfaces of said board-connecting terminals are flush with the one side of said flange; and subsequently connecting the board-connecting terminals of the connector respectively to the solder portions at the one side of the circuit board.

4. The method of claim 3, wherein the connector has a plurality of fixing metal members, and wherein the method further comprises a step of securing the fixing metal members fixedly to the one side of the circuit board by soldering simultaneously when the board-connecting terminals are connected to the solder portions, respectively.

5. The construction of claim 1, wherein said board-connecting terminals of the connector includes a rise portion and a connecting portion, said rise portion extending along a side surface of said flange, and said connecting portion disposed outwardly from said flange so as to define the solder-connecting surface being flush with the one side of said flange.

6. The method of claim 3, wherein said board-connecting terminals of the connector include a rise portion and a connecting portion, said rise portion extending along a side surface of said flange, and said connecting portion disposed outwardly from said flange so as to define the solder-connecting surface being flush with the one side of said flange.

* * * * *